US010336119B2

(12) United States Patent
Meyers et al.

(10) Patent No.: US 10,336,119 B2
(45) Date of Patent: Jul. 2, 2019

(54) APPARATUS FOR BINDING STACKS OF FLAT PARTS

(71) Applicant: Henkel AG & Co. KGaA, Duesseldorf (DE)

(72) Inventors: Michael Meyers, Gangelt (DE); Ralf Grauel, Hilden (DE); Ralf Gossen, Duisburg (DE); Norbert Bialas, Dormagen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/799,331

(22) Filed: Mar. 13, 2013

(65) Prior Publication Data

US 2013/0266402 A1 Oct. 10, 2013

Related U.S. Application Data

(63) Continuation of application No. PCT/EP2011/068960, filed on Oct. 28, 2011.

(30) Foreign Application Priority Data

Oct. 29, 2010 (DE) ..... 10 2010 043 156

(51) Int. Cl.
*B42C 9/00* (2006.01)

(52) U.S. Cl.
CPC ..... *B42C 9/0006* (2013.01)

(58) Field of Classification Search
CPC ..... B42C 9/00; B42C 11/00; B42C 11/02; B42C 13/00; B42C 5/02; B42C 9/0006; B42B 5/00
USPC ..... 412/1, 4, 5, 6, 8, 9, 19, 20, 22, 30, 33, 412/37, 900
See application file for complete search history.

(56) References Cited

U.S. PATENT DOCUMENTS

| | | | | |
|---|---|---|---|---|
| 5,108,244 | A * | 4/1992 | Bellanca | B42C 11/045 412/16 |
| 6,010,293 | A * | 1/2000 | Uno | B42C 9/0012 412/1 |
| 2001/0019691 | A1* | 9/2001 | Boss | 412/22 |
| 2003/0077148 | A1* | 4/2003 | Carter | B42C 9/0006 412/19 |
| 2004/0011457 | A1* | 1/2004 | Kobayashi et al. | 156/272.2 |
| 2004/0028505 | A1* | 2/2004 | Bilbrey | B42C 9/0068 412/8 |

(Continued)

FOREIGN PATENT DOCUMENTS

| | | |
|---|---|---|
| DE | 202007010983 | 11/2007 |
| WO | 2007115745 | 10/2007 |
| WO | 2008070559 | 6/2008 |

OTHER PUBLICATIONS

International Search Report issued in connection with International Patent Application No. PCT/EP2011/068960 dated Mar. 2, 2012.

*Primary Examiner* — Justin V Lewis
(74) *Attorney, Agent, or Firm* — James E. Piotrowski

(57) ABSTRACT

An apparatus for binding stacks of flat parts comprising a fixing unit for fixing a stack consisting of a plurality of flat parts, a binder application device for applying liquid binder along a narrow face of the stack, and an irradiating unit for curing the binder by irradiating the binder on the narrow face of the stack, a light-emitting diode unit being used for irradiation.

6 Claims, 1 Drawing Sheet

(56) References Cited

U.S. PATENT DOCUMENTS

| | | | | |
|---|---|---|---|---|
| 2005/0238462 | A1* | 10/2005 | Oota | B42C 9/0012 412/9 |
| 2006/0072982 | A1* | 4/2006 | Hoarau | B42C 9/0006 412/8 |
| 2009/0025881 | A1* | 1/2009 | Westermann | B42C 9/00 156/379.6 |
| 2010/0032585 | A1* | 2/2010 | Caiger | B05D 3/067 250/492.1 |
| 2010/0236089 | A1* | 9/2010 | Kawasaki | G03F 7/2022 34/275 |

* cited by examiner

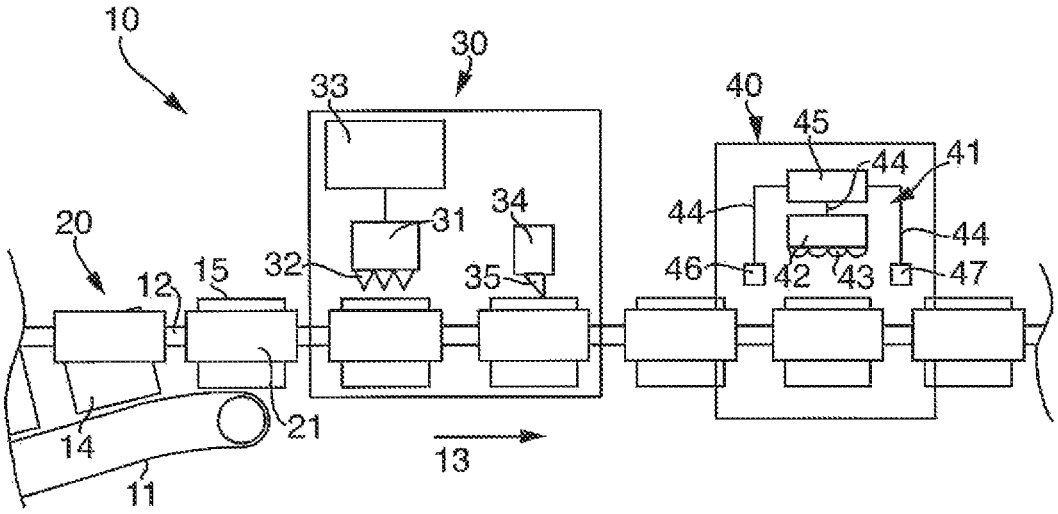
10
30
33
40
45
44
41
44
44
20
31
34
12
15
32
35
46
42
43
47
14
21
13
11

APPARATUS FOR BINDING STACKS OF FLAT PARTS

The invention relates to an apparatus for binding stacks of flat parts, such as for example book blocks, in particular for producing brochures and books, comprising a binder application device for applying liquid binder along a narrow face of the stack, for example by relative motion of the narrow face of the stack and the binder application device relative to one another.

Many kinds of such apparatuses are in practical use and are in particular used for binding books.

WO2007115745 in particular discloses such an apparatus. Ultraviolet light is here used for curing the binder and a UV light source is accordingly used as the radiation source. A shutter is provided for the radiation source, on the one hand to allow the passage of the luminous radiation for a specific period for curing the binder and on the other hand to prevent emission of unwanted ultraviolet radiation during any interruptions in production. The UV light source furthermore comprises a water cooling apparatus for cooling purposes.

One drawback of the apparatus shown here is the elaborate radiation source. As a result of the use of a UV light source, it is necessary to use further components, such as for instance a shutter with control system and a water cooling apparatus. This not only increases costs but also the space required for the radiation source and thus for the overall apparatus.

The object of the invention is therefore to provide an improved apparatus which overcomes the above-stated disadvantages.

Said object is achieved by the features of claim 1.

Advantageous configurations of the invention are indicated in the subclaims.

The basic concept of the invention is to use an apparatus for binding stacks of flat parts comprising a fixing unit for fixing a stack consisting of a plurality of flat parts, a binder application device for applying liquid binder along a narrow face of the stack and an irradiating unit for curing the binder by means of preferably two-dimensional irradiation of the binder on the narrow face of the stack, a light-emitting diode unit being used for irradiation.

Flat parts which may here be used are preferably sheets of paper or comparable products which may in particular be used for writing and printing. Such flat parts may in particular consist of fibrous materials, such as groundwood pulp, semi-chemical pulps, pulps and/or other fibers. They may additionally comprise a sizing and/or impregnation, such as for example animal sizes, resins, paraffins, and/or waxes. Such flat parts may also comprise fillers such as in particular kaolin, talcum, gypsum, barium sulfate, chalk and/or titanium white together with auxiliary substances such as for example water, colorants, defoamers, dispersants, retention agents, flocculants and/or wetting agents. Numerous suitable grades of paper which are suitable for stacking and binding are known from the prior art.

An apparatus according to the invention is preferably in particular used in book production. A book may here [consist] of a collection or stack of printed, written, painted and/or empty sheets of flat parts, such as for example paper or other suitable materials. Such books may in particular take the form of hardcovers, paperbacks, brochures or softcovers.

To this end, the apparatus comprises a fixing unit for fixing a stack of a plurality of flat parts. The fixing unit may to this end comprise a plurality of mobile clamps. The stack is preferably fixed such that it comprises at least one narrow face. This may be taken to mean a side of the stack, which side is formed by the edges of the flat parts. The flat parts may be bound to one another, for example by means of a binder, on said narrow face.

The apparatus may moreover comprise a machining unit in order to machine the narrow face of the stack for example by means of fanning, notching, sawing, milling, grinding, brushing and/or cleaning. The use of a machining unit is here in particular suitable when producing a book with a soft cover, such as a paperback or brochure.

An apparatus according to the invention furthermore comprises a binder application device for applying liquid binder or adhesive along the narrow face of the stack. For applying the binder, the binder application device may here in particular comprise one or more nozzles and/or one or more rollers and/or other suitable application devices. The binder is preferably applied onto the narrow face in a thickness in the range from 0.1 mm to 1.0 mm, particularly preferably in a range from 0.3 mm to 0.6 mm. In order to adjust the film thickness of the coating agent, the binder application device may comprise a stripper unit, in particular a doctor blade and/or a spinner. The binder used is preferably radiation-curing and may to this end comprise photoinitiators which are activatable at a specific wavelength of incident radiation in order to cure the binder.

In the apparatus according to the invention, the binder is cured using an irradiating unit or curing unit. The irradiating unit irradiates the binder applied onto the narrow face of the stack preferably two-dimensionally. It has here proven particularly advantageous to use a light-emitting diode unit for irradiation. The light-emitting diode unit here comprises at least one light-emitting diode. Preferably, however, the light-emitting diode unit comprises a plurality of light-emitting diodes. Such light-emitting diodes (abbreviated LED) have been known for some considerable time. Such an LED usually consists of an anode terminal, a cathode terminal and may comprise a trough or well in which a semiconductor LED crystal is inserted. This LED crystal is connected via a bonding wire to the anode terminal. In order to protect not only the cathode terminal and the anode terminal but also the LED crystal, these components are mainly encapsulated in a usually transparent plastics sheath or "encapsulation". This encapsulation may here take the form of a lens, such that the beam of light emitted by the LED crystal is emitted for example over the largest possible area or alternatively punctually.

The particular advantage of the apparatus according to the invention is the use of said light-emitting diode unit for irradiating and curing the binder. Many advantages may be achieved in this way. In comparison with the lamps or tubes used in the prior art for curing the binder, the service life of such light-emitting diode units is very long. In addition, no or virtually no heating up or cooling down time is required for such light-emitting diode units, such that the light-emitting diodes may be switched on for irradiation and switched off after irradiation. Considerable energy savings can be made in this manner. In addition, many additional components may be dispensed with, in particular less elaborate covering or shrouding is necessary. A further advantage is the high level of efficiency of a light-emitting diode unit, as low waste heat losses may be achieved. On the one hand, the workpiece, in this case not only the stack of flat parts and the binder to be irradiated but also the apparatus, such as for example a book binding machine and its components, are exposed to virtually no heat. On the other hand, elaborate and costly cooling apparatuses, such as for example water cooling systems, may be dispensed with.

Such a light-emitting diode unit is furthermore advantageous from an environmental protection standpoint in comparison with conventional irradiating units, which usually make use of mercury vapor lamps for irradiation, because heavy metals, such as for example mercury for mercury vapor lamps, generally do not need to be used for producing a light-emitting diode unit.

Furthermore, the space required for the irradiating unit may be reduced by using a light-emitting diode unit. Whereas known irradiating units usually have to be located directly downstream of the binder application device, in order to minimize the space requirement for the entire apparatus, the light-emitting diode unit may be located at a greater distance from the binder application device on account of its small size and due to the absence of large shutters, enclosures and cooling apparatuses. The consequent possibility of locating the irradiating unit further away from the binder application device has the advantage, in particular in book binding, that adequate time can be provided for the binder to be able to bind with fibers of the flat parts, which preferably consist of paper, in order to ensure the best possible bonding of the fibers by means of the binder. The irradiating unit is here preferably not fixedly connected to the binder application device and/or the entire apparatus, such that the distance between the binder application device and the irradiating unit may be varied and in particular adapted to the binder used and/or to the dimensions of the stack and/or to the material and the nature of the flat parts of the stack.

A further advantage here is the use of a light-emitting diode unit which emits radiation in a specific UV spectrum, a binder being used which comprises photoinitiators which are activatable on irradiation by the radiation emitted by the light-emitting diode unit in order to enable curing of the binder by means of the light-emitting diode unit. By using such a light-emitting diode unit in conjunction with the use of the appropriate binder, it is possible to enable irradiation in which all the radiation from the light-emitting diode unit falls within the curing range of the binder. In this way, binder curing efficiency may be increased, such that more rapid curing is possible.

A further advantage here is the use of a light-emitting diode unit which emits radiation in the UVA spectrum, a binder being used which comprises photoinitiators which are activatable under UVA radiation. This has the advantage that the light-emitting diode unit does not need to be so elaborately and comprehensively enclosed and/or shielded in order for example to protect operators from harmful UVB and/or UVC radiation, which may result in cost savings and/or reduced space requirements.

It has proven particularly advantageous to use a light-emitting diode unit which exclusively emits radiation with a wavelength in a wavelength range of 320 nm-410 nm. A wavelength in a range from 375 nm-405 nm is here preferred. The biological action of such radiation in the stated spectrum may be classed for operators of the apparatus as being less harmful than for example radiation in the UVB or UVC range, such that it is possible to dispense with elaborate enclosure of the light-emitting diode unit. It has here proven particularly advantageous to use a binder which comprises photoinitiators which are activatable at the wavelength of the radiation from the light-emitting diode unit.

Such a light-emitting diode unit furthermore has safety advantages over conventional irradiating units, in which mercury vapor lamps are usually used for irradiation. When UV light from conventional mercury vapor lamps with a wavelength of less than 240 nm hits an oxygen molecule in the ambient air, it splits the molecule into two oxygen atoms. These atoms react with other oxygen molecules to yield 2 ozone molecules. An extraction system would be required for the resultant ozone. Due to the use of a light-emitting diode unit of the described type, which emits radiation in an above-described spectrum, the formation of ozone may be prevented such that it is possible to dispense with a costly and bulky extraction system.

It is furthermore advantageous to use at least one LED lighting panel as the light-emitting diode unit or as part of the light-emitting diode unit. Such a lighting panel may preferably comprise a plurality of LEDs or LED light sources which may in particular be arranged in one plane. The use of a lighting panel makes it possible to enlarge the area to be irradiated. A larger area of the narrow face of the stack provided with binder may accordingly be irradiated for curing the binder. In general, the stacks are conveyed past the light-emitting diode unit for curing the binder. Thanks to the use of a lighting panel, the irradiation time on a specific surface portion of the narrow face provided with binder may be increased without having to reduce the conveying speed of the stack, which may result in improved curing.

It has here proven particularly advantageous to use at least one LED lighting panel which is equipped with a reflecting arrangement. The performance characteristics of the LED lighting panel may be improved by such a reflecting arrangement. The LEDs used are here positioned in front of a reflecting surface of the reflecting arrangement, a direction of emission of a ray from the LEDs extending contrary to the main emission direction of the lighting panel and the ray from the LEDs being deflected by reflection into the main emission direction of the lighting panel.

It is furthermore advantageous to arrange the light-emitting diode unit such that the binder is irradiated on the narrow face of the stack at a distance in a range from 1 cm to 10 cm, preferably in a range from 4 cm to 6 cm, in order to ensure reliable curing of the binder. An irradiation distance of approx. 5 cm has proven particularly advantageous here.

It is furthermore advantageous to use a light-emitting diode unit which [has] an intensity of at least 100 $mW/cm^2$, preferably in a range of 100 $mW/cm^2$ to 300 $mW/cm^2$, particularly preferably in a range of 180 $mW/cm^2$ to 200 $mW/cm^2$. An intensity of roughly 190 $mW/cm^2$ has proven particularly advantageous.

It is nevertheless also conceivable to use light-emitting diode units with higher intensities. However, using light-emitting diode units with particularly elevated intensities, for example with an intensity of several $W/cm^2$, may entail the use of a cooling apparatus for the light-emitting diode unit.

The light-emitting diode unit and for example the apparatus are preferably constructed that a radiation dose which may be input by means of the light-emitting diode unit, for example onto the narrow face, is within a defined range. For the purposes of the present invention, the radiation dose should be taken to mean a value for the radiation input onto a specific area which is calculated by multiplying the intensity of the light-emitting diode unit by the time for which the substrate to be irradiated is irradiated.

The radiation dose may accordingly be dependent on the speed at which the stack and thus in particular the narrow face to be irradiated is conveyed through the irradiation field of the preferably stationary light-emitting diode unit. The dimensions of the light-emitting diode unit or the dimensions of the irradiation field may additionally influence the radiation dose.

In a preferred exemplary embodiment, the light-emitting diode unit takes the form of a lighting panel which has a longitudinal extent in the conveying direction of the stack of 100 mm. Alternatively, such a lighting panel may for example be constructed with suitable reflectors such that, while said length does indeed differ from that stated above, the irradiation field at the level of a substrate to be irradiated, in particular a narrow face, exhibits a length of 100 mm in the conveying direction of the stack.

In said preferred exemplary embodiment, the stacks are conveyed at a speed of 100 m/min and pass at this speed through the irradiation field. The dose for the light-emitting diode unit, which in the present case takes the form of a lighting panel, accordingly amounts, at an intensity of a lighting panel used of at least 100 $mW/cm^2$, to at least 6 $mJ/cm^2$. Under the above-stated parameters, this dose is particularly preferably in a range from 6 $mJ/cm^2$ at an intensity of 100 $mW/cm^2$ to 18 $mJ/cm^2$ at an intensity of 300 $mW/cm^2$.

In one particularly preferred exemplary embodiment, a plurality of series-connected lighting panels is used as the light-emitting diode unit. It is, for example, conceivable to use four lighting panels, such that the dose would increase fourfold and for example at a speed of 100 m/min would amount at a lighting panel intensity of 100 $mW/cm^2$ to 16 $mJ/cm^2$.

The present invention also provides the use of an irradiating unit or curing unit for an apparatus for binding stacks of flat parts for curing the binder by means of preferably two-dimensional irradiation of the binder on a narrow face of the stack, a light-emitting diode unit being used for irradiation. Such an irradiating unit may in particular be used for retrofitting to an existing apparatus for binding stacks of flat parts. It is here conceivable to carry out general retrofitting of apparatuses, such as for example bookbinding machines, the bookbinding machine to be retrofitted not yet comprising an irradiating unit. The irradiating unit according to the invention may additionally replace an existing irradiating unit in order to achieve the above-stated advantages. The light-emitting diode unit preferably emits radiation in a specific UV spectrum, a binder being used which comprises photoinitiators which are activatable on irradiation by the radiation emitted by the light-emitting diode unit in order to enable curing of the binder by means of the light-emitting diode unit. A further advantage is here the use of a light-emitting diode unit which emits radiation in the UVA spectrum, a binder being used which comprises photoinitiators which are activatable under UVA radiation. The light-emitting diode unit preferably exclusively emits radiation with a wavelength in a wavelength range of 320 nm-410 nm. A wavelength in a range from 375 nm-405 nm is here particularly preferred. It has here furthermore proven advantageous for the binder to comprise photoinitiators which are activatable at the wavelength of the radiation of the light-emitting diode unit.

It is furthermore advantageous when using an above-stated irradiating unit to make use of a light-emitting diode unit which comprises at least one LED lighting panel. It may here prove advantageous for the LED lighting panel(s) to be equipped with one or more reflecting arrangements.

The present invention also provides a method for binding stacks of flat parts comprising the following steps:

fixing a stack of a plurality of flat parts, applying liquid binder along a narrow face of the stack, curing the binder by means of preferably two-dimensional irradiation of the binder on the narrow face of the stack, a light-emitting diode unit being used for irradiation.

In addition, in particular when producing a brochure and/or a paperback or softcover book, it may prove advisable after the fixing step to provide a machining step of the stack of flat parts, this in particular possibly being taken to mean machining of the narrow face of the stack, such as for example spine machining, in particular fanning, notching, sawing, milling, grinding, brushing and/or cleaning the narrow face.

It is furthermore advantageous to use a light-emitting diode unit during curing which exclusively emits radiation with a wavelength in a wavelength range of 320 nm-410 nm.

It has furthermore proven advantageous for the narrow face of the stack and/or the binder on the narrow face of the stack to be irradiated at a distance in a range of 1 cm to 10 cm, particularly preferably in a range of 4 to 6 cm, preferably for instance of 5 cm.

A preferred exemplary embodiment of the present invention is described below, the sole FIG. 1 showing an apparatus for binding stacks of flat parts.

In the schematic view shown in FIG. 1, the apparatus according to the invention is used as a bookbinding machine 10. Such bookbinding machines 10, such as for example perfect binders, are used to produce adhesively bound brochures or book blocks for hardcover books, the flat parts, for example folded sheets and/or individual sheets, assembled into a stack 14 being bound by application of an adhesive or binder onto a narrow face 15 or block spine. This narrow face 15 is frequently additionally machined, in particular by fanning, notching, sawing, milling, grinding, brushing and/or cleaning, prior to application of the binder.

The bookbinding machine 10 shown comprises a fixing unit 20 for fixing the stack 14 of a plurality of flat parts. In the exemplary embodiment shown, the flat parts are stacked in known manner in a part of the bookbinding machine 10 which is not known. The prior art describes many solutions to this end. The stacks here comprise at least one narrow face 15 which is used for binding. In the present exemplary embodiment, a binder which is applied onto the narrow faces 15 of the stack 14 is used for this purpose. Curing of the binder is then provided in order to obtain brochures or book blocks from the stacks.

The stacks 14 are conveyed by a conveyor belt-like feed means 11 for further machining and processing. The feed means 11 is arranged such that the stack 14 is guided from below to clamps 21 open at the bottom, the stacks 14 in turn being arranged on the feed means 11 such that said narrow face 15 is located opposite the feed means 11 and is thus uncovered.

These clamps 21 are part of the fixing unit 20 and serve to fix the stack 14 for further machining and processing. The clamps 21 grip around the stack 14 in places and are constructed such that at least said narrow face 15 is uncovered. The clamps 21 are constructed such that a region of the side faces, adjacent to the narrow face 15, of a stack 14 is also uncovered, in order for example to apply binder in places thereto. The clamps 21 are fixedly connected to a conveyor system 12. Such conveyor systems 12 are known in the prior art. The part to which the clamps 21 are fastened may here in particular be of chain-like construction. By moving the chain-like part in a conveying direction 13, the stacks 14 fixed in the clamps 21 may be moved for further machining and processing in the bookbinding machine 10.

A machining unit (not shown) may be provided for further machining, in particular of the narrow face 15. The narrow face 15 may here in particular be machined by fanning, notching, sawing, milling, grinding, brushing and/or cleaning prior to application of binder.

The stacks 14 fixed in the clamps 21 are conveyed by moving the clamps 21 in the conveying direction 13 by means of the conveyor system 12 to a binder application device 30 located downstream of the fixing unit 20 or of the machining unit (not shown) for applying a liquid binder onto the narrow face 15. The binder application device 30 comprises an application unit 31 for applying the binder via a plurality of nozzles 32 and a tank 33 for the binder. It goes without saying that an individual nozzle may also be used for applying the binder. As an alternative to the nozzles 32, the binder may also be applied via one or more rollers or another suitable application element. In addition, the tank 33 may comprise a heating unit in particular in order to heat the binder, for example a hot-melt adhesive. The application unit 31 and the nozzles 32 and any hose connections in particular between the tank 33 and application unit 31 may furthermore be heatable, in order to heat the binder, for example a hot-melt adhesive. An in particular externally arranged storage tank (not shown) may also be provided, in which the binder, in particular a hot-melt adhesive, may be heated up to a premelting range.

A hot-melt adhesive is preferably used as the binder in the bookbinding machine 10 shown. A hot-melt adhesive is taken to mean those adhesives which are solid at room temperature (25° C.), but melt at elevated temperature and are may be applied in the liquid state. Particularly suitable hot-melt adhesives are radiation-crosslinking adhesives. In particular, a suitable hot-melt adhesive is one which comprises photoinitiators which are activatable for curing under UVA radiation. A hot-melt adhesive is preferably used which comprises photoinitiators which are activatable under radiation with a wavelength in a range of 320 nm-410 nm. A hot-melt adhesive is particularly preferably used which comprises photoinitiators which are activatable under radiation with a wavelength in a wavelength range of 375 nm-405 nm.

A suitable hot-melt adhesive manner preferably exhibits a viscosity in a range of 2500 mPa·s to 15000 mPa·s, particularly preferably in a range of 3000 mPa·s to 8000 mPa·s (measured to EN ISO 2555, Brookfield viscometer, at 130° C.) and a premelting range of 60° to 120°. The application temperature of the adhesive is selected such that the adhesive may be applied in liquid or flowable form by the apparatus according to the invention, for example between 110° C. and 140° C. It is furthermore suitable for a such hot-melt adhesive to use a heatable glue reservoir or tank 33 which is capable of heating the hot-melt adhesive to at least 110° to 140°, and said nozzles 32 in a range of 110° to 140°. If, when gluing or applying binder to very thick stacks 14, the delivery capacity is no longer sufficient, an option may be provided for increasing the temperature by up to 50°. Where cooling occurs after application of the adhesive layer, an initial adhesive bond is provided by solidification of the hot-melt adhesive. After irradiation, the final adhesive bond strength is achieved.

In addition, the binder application device 30 may comprise an additional application option for a binder as side glue. A binder is here applied in places to the side faces, adjacent to the narrow face 15, of the stack 14 in order in a further step for example to bond a title page or an end sheet adhesively to the stack 14. This title page in particular serves to cover the adhesive strip, i.e. it conceals lateral visibility of the binder arranged on the narrow face 15. Binder is preferably applied via the application unit 31 both onto the narrow face 15 and onto said side faces via further nozzles (not shown). Different binders are preferably used for the side faces and the narrow face 15, in order to enable different curing and effective adhesive bonding for example of a front page after prior curing of the binder on the narrow face 15. It is, however, also conceivable to use the same binder for all the above-stated regions.

The binder application device 30 furthermore comprises a stripper unit 34 with a stripper element 35. In the exemplary embodiment shown, this takes the form of a doctor blade. The stripper unit 34 ensures a uniform film thickness of binder on the narrow face 15. The stripper unit 34 may here be adjusted such that the thickness of the binder on the narrow face 15 may be adjusted to a film thickness in a range of 0.1 mm to 1.0 mm, preferably in a range of 0.3 mm to 0.6 mm.

The stacks 14 provided with binder are then conveyed onwards by means of the clamps 21 in the conveying direction 13 to a curing unit or irradiating unit 40 for curing the binder by means of two-dimensional irradiation of the binder on the narrow face 15 of the stack 14. In the exemplary embodiment shown, the irradiating unit 40 comprises a light-emitting diode unit 41 for irradiation of the binder. The light-emitting diode unit 41 used emits radiation in a specific UV spectrum. The above-stated binder here comprises photoinitiators which are activatable under the radiation emitted by the light-emitting diode unit, in order to enable curing of the binder by means of the light-emitting diode unit 41. The radiation emitted by the light-emitting diode unit 41 is here within the UVA spectrum. Thanks to the use of such a light-emitting diode unit 41, it is in particular possible to dispense with elaborate shielding of said unit.

The light-emitting diode unit 41 used comprises a plurality of light-emitting diodes 43 which exclusively emit radiation with a wavelength in a wavelength range of 320 nm-410 nm. A wavelength in a range from 375 nm-405 nm is here particularly preferred. It is here conceivable for the wavelength of the light-emitting diodes 43 to be adjustable, such that a wavelength from the above-stated wavelength ranges may be selected in order to adapt the radiation to the binder used. More precisely, the light-emitting diode unit 41 comprises at least one LED lighting panel 42 which in turn comprises a plurality of light-emitting diodes 43. The light-emitting diode unit 41 additionally comprises a control unit 45 for controlling the lighting panel 42 and electrical lines 44 via which the lighting panel 42 is connected to the control unit 45. The lighting panel furthermore comprises a reflecting arrangement (not shown) in order to deflect radiation which does not extend in the main emission direction, thus preferably in the direction of the narrow face 15. The light-emitting diodes 43 are here positioned in front of a reflecting surface of the reflecting arrangement, a direction of emission of a ray from the light-emitting diodes 43 extending contrary to the main emission direction of the lighting panel 42 and the ray from the light-emitting diodes 43 being deflected by reflection via the reflecting arrangement into the main emission direction of the lighting panel 42.

The lighting panel 42 is here arranged such that the main radiation direction or main emission direction of the light-emitting diodes 43 is oriented in the direction of the narrow face 15 provided with binder. In addition, the lighting panel 42 and/or the entire light-emitting diode unit 41 may be displaced in height with regard to the stack 14 such that the distance of the light-emitting diodes 43 from the surface of the narrow face 15 provided with binder may be varied in order to set an ideal irradiation distance for curing the binder. Stacks 14 with different dimensions may accordingly also be processed using the bookbinding machine 10 shown. In the exemplary embodiment shown, the narrow face 15 is irradiated at a distance in a range of 1 cm to 10 cm, preferably in a range of 4 cm to 6 cm. The light-emitting diode unit 41 is preferably positioned such that the light-emitting diodes 43 are arranged at a distance of roughly 5 cm from a central binder surface on the narrow face 15.

The binder is here cured using a lighting panel 42 with light-emitting diodes 43 which are capable of providing an intensity in a range of 100 $mW/cm^2$ to 300 $mW/cm^2$, preferably in a range of 180 $mW/cm^2$ to 200 $mW/cm^2$, particularly preferably an intensity of roughly 190 $mW/cm^2$.

The irradiating unit 40 furthermore comprises a first light barrier 46 and a second light barrier 47. Both light barriers 46, 47 are connected via electrical lines 44 to the control unit 45. The light barriers 46, 47 may, it goes without saying, also be replaced by other sensors known to a person skilled in the art which are suitable for detecting the presence a stack 14. When a stack 14 is moved by means of the clamp 21 and the conveyor system 12 towards the irradiating unit 40, it passes through a detection zone of the first light barrier 46. Said light barrier is arranged such that the stack 14 reaches the detection zone before reaching the irradiation field of the lighting panel 42. When a stack 14 reaches the detection zone of the first light barrier 46, the latter transmits a signal to the control unit 45, which thereupon switches on the lighting panel 42 for irradiation of the binder on the narrow face 15. The second light barrier 47 is arranged such that departure of the stack 14 from the irradiation field of the lighting panel 42 may be detected. The signal detected in this manner by the second light barrier 47 is in turn transmitted to the control unit 45, which switches off the lighting panel 42. It this manner, it is possible to ensure that the lighting panel 42 only emits radiation when there actually is a stack 14 in the irradiation field. In addition, the irradiating unit 40 may additionally or alternatively for example be connected directly via the control unit 45 to the conveyor system 12 in such a manner that for example details regarding the speed or position of the clamps 21 in the bookbinding machine 10 may be picked up, whereby switching of the lighting panel 42 for irradiation of the narrow face 15 may be enabled in addition or as an alternative to the light barriers 46, 47.

It is also conceivable to use a delay circuit (not shown), for example as part of the control unit 45, which switches on the lighting panel 42 as soon as a stack 14 reaches or passes through the first light barrier 46. If, however, in a predetermined period, for example in a period selectable from a range of 1 s to 10 s, no further stack 14 is detected by the first light barrier 46 and/or the second light barrier 47, the control unit 45 switches the lighting panel 42 off. By means of such a delay circuit, it is in particular possible to provide an irradiating unit 40 which is usable and operable independently of the other modules of the bookbinding machine 10. Such a solution is advantageous in particular for retrofitting existing bookbinding machines 10 with a described irradiating unit 40, since the irradiating unit need not be connected to the control system of the bookbinding machine 10 as switching of the lighting panel 42 is exclusively effected by the detection of data and measured values carried out by the irradiating unit 40 itself.

The bookbinding machine 10 furthermore comprises a measuring apparatus (not shown) for detecting the radiation dose input by the irradiating unit 40 via the lighting panel 42 onto the substrate, thus in particular the narrow face 15, or onto the binder on the narrow face 15. Said measuring apparatus may for example be part of the irradiating unit 40. Preferably, however, this measuring apparatus is connected to the conveyor system 12 and moves for example with the clamps 21. In this manner, the measuring apparatus passes through the irradiating unit 40 at the same speed as the stack 14, such that the dose may be accurately detected. The measuring apparatus may here be connected to the control unit 45 of irradiating unit 40 via a wireless data transmission means in order optionally to adapt the radiation dose or the speed of the conveyor system 12.

The light-emitting diode unit 41 may additionally comprise further lighting panels 42 or the described lighting panel 42 may be constructed such that binder possibly applied in the binder application device as side glue onto regions of the side face of the stack 14 may be irradiated. To this end, it may also be appropriate to design the lighting panel 42 such that the light-emitting diodes 43 are arranged in the manner of a tunnel in the lengthwise direction with regard to the narrow face 15 of a stack 14 and in this manner are capable of irradiating both the narrow face 15 itself and the side faces.

Using the bookbinding machine 10 shown, it is accordingly possible to provide a method for binding stacks 14 of flat parts, which method comprises the following steps:

- fixing a stack 14 consisting of a plurality of flat parts by means of a fixing unit 20, applying liquid binder along a narrow face 15 of the stack 14 by means of a binder application device 30,
- curing the binder by means of two-dimensional irradiation of the binder on the narrow face 15 of the stack 14 by means of an irradiating unit 40, a light-emitting diode unit 41 being used for irradiation.

The irradiating unit 40 shown may also be used for retrofitting to an existing bookbinding machine 10. Known bookbinding machines 10 may often comprise means for curing which inter alia emit hazardous UVB and UVC radiation. In this case, an irradiating unit 40 shown in FIG. 1 may be used which replaces the existing means for curing. In this case too, the irradiating unit 40 for retrofitting to the bookbinding machine 10 comprises said light-emitting diode unit, preferably comprising a lighting panel 42. A lighting panel 42 used here may also comprise a described reflecting arrangement. In addition, the installed light-emitting diodes 43 preferably exhibit the above-described properties.

LIST OF REFERENCE NUMERALS

10 Bookbinding machine
11 Feed means
12 Conveyor system
13 Conveying direction
14 Stack
15 Narrow face
20 Fixing unit
21 Clamp
30 Binder application device
31 Application unit
32 Nozzles
33 Tank
34 Stripper unit
35 Stripper element
40 Irradiating unit
41 Light-emitting diode unit
42 LED lighting panel
43 LED
44 Electrical line
45 Control unit
46 First light barrier
47 Second light barrier

What is claimed is:

1. An apparatus for binding stacks of flat parts comprising a plurality of flat parts, each flat part having opposing faces and a plurality of edges, a fixing unit for fixing a stack, the fixed stack comprising the plurality of flat parts arranged in face to face orientation with edges aligned to provide the stack with opposing faces and a plurality of stack edges extending between the faces, one of the stack edges being an unbound spine edge, a binder application device for heating a hot melt adhesive to a liquid state and applying the liquid hot melt adhesive along the unbound spine edge, the adhesive comprising photoinitiators which are activatable by exposure to radiation in a wavelength range of 320 nm to 410 nm to cure the adhesive along the unbound spine edge, an irradiating unit for curing the adhesive by irradiating the adhesive on the unbound spine edge, the irradiating unit comprising a plurality of semiconductor light-emitting diode units, wherein the light-emitting diode units exclusively emit radiation with a wavelength in a wavelength range of 320 nm to 410 nm.

2. The apparatus according to claim 1, wherein the light-emitting diode unit comprises at least one LED lighting panel.

3. The apparatus according to claim 1, wherein the light-emitting diode unit is arranged such that the binder is irradiated on an edge of the stack at a distance in a range from 1 to 10 cm.

4. The apparatus according to claim 1 wherein the stack of flat parts is bound only by cured binder.

5. A method for binding stacks of flat parts comprising the following steps providing a plurality of flat parts, each flat part having opposing faces and a plurality of edges fixing the plurality of flat parts into a stack, the stack comprising the plurality of flat parts arranged in face to face orientation with edges aligned, the flat part edges defining respective stack edges, one of the stack edges being an unbound spine edge, heating a radiation curing hot melt adhesive to a liquid form, applying the liquid, radiation crosslinking hot melt adhesive along the unbound spine, cooling the liquid hot melt adhesive to solid form on the spine edge, curing the hot melt adhesive by means of two-dimensional irradiation of the binder on the spine edge of the fixed stack, a light-emitting diode unit being used for irradiation;

wherein the light-emitting diode unit exclusively emits radiation with a wavelength in a wavelength range of 320 nm to 410 nm.

6. An apparatus for binding stacks of flat parts comprising a plurality of flat parts, each flat part having opposing faces and a plurality of edges, a fixing unit for fixing a stack, the fixed stack comprising the plurality of flat parts arranged in face to face orientation with edges aligned to provide the stack with opposing faces and a plurality of stack edges extending between the faces, one of the stack edges being an unbound spine edge, a binder application device for heating a hot melt adhesive to a liquid state and applying the liquid hot melt adhesive along the unbound spine edge, the hot melt adhesive comprising photoinitiators with are activatable by exposure to radiation in a wavelength range of 320 nm to 410 nm to cure the adhesive along the unbound spine edge, wherein the binder application device comprises a heatable tank for melting the hot melt adhesive, an irradiating unit for curing the applied adhesive by irradiating the adhesive on the unbound spine edge, a light-emitting diode unit being used for irradiation, wherein the light-emitting diode unit exclusively emits radiation with a wavelength in a wavelength range of 320 nm to 410 nm.

* * * * *